United States Patent [19]

Smith

[11] Patent Number: 4,873,407

[45] Date of Patent: Oct. 10, 1989

[54] DIELECTRIC CROSS MACHINE MOISTURE CONTROL

[75] Inventor: Douglas W. P. Smith, Port Coquitlam, Canada

[73] Assignee: Devron-Hercules, Inc., North Vancouver, Canada

[21] Appl. No.: 312,438

[22] Filed: Feb. 17, 1989

Related U.S. Application Data

[63] Continuation of Ser. No. 946,421, Dec. 24, 1986, abandoned.

[51] Int. Cl.[4] ..... H05B 6/54

[52] U.S. Cl. ..... 219/10.43; 219/10.77; 219/10.81; 219/10.61 R

[58] Field of Search ..... 219/10.43, 10.61 R, 219/10.67, 10.71, 10.81, 10.69

[56] References Cited

U.S. PATENT DOCUMENTS

| | | | |
|---|---|---|---|
| 3,470,343 | 9/1969 | Bilbrough | 219/10.61 |
| 3,701,875 | 10/1972 | Witsey et al. | 219/10.61 |
| 4,258,241 | 3/1981 | Soworowski | 219/10.71 |
| 4,307,276 | 12/1981 | Kurata et al. | 219/10.41 |
| 4,409,455 | 10/1983 | Belcher et al. | 219/10.81 |
| 4,574,413 | 3/1986 | Otting et al. | 219/10.61 R |
| 4,621,177 | 11/1986 | Pulkowski et al. | 219/10.71 |

*Primary Examiner*—M. H. Paschall

*Attorney, Agent, or Firm*—Christie, Parker & Hale

[57] ABSTRACT

In a method for applying heat to a web, the web is subjected to dielectric heating in discrete segments, arranged transverse to the web, by modules containing pairs of electrodes. The heat thus generated can be used to vary the moisture and/or temperature profile. Each module has a built-in self modulating moisture leveler. Other properties of the web, which are varied by such process operations as wet pressing, drying, calendering, etc. and which themselves are influenced by the moisture/temperature of the web can thereby be also controlled by said dielectric heating in closed-loop fashion.

11 Claims, 3 Drawing Sheets

DIELECTRIC CROSS MACHINE MOISTURE CONTROL

CROSS-REFERENCE TO RELATED APPLICATIONS

This is a continuation of application Ser. No. 06/946,421, filed Dec. 24, 1986 now abandoned.

FIELD OF THE INVENTION

This invention relates to a method of applying energy to a web, especially a paper web on a paper making machine. More specifically the invention relates to a method of using dielectric heating in discrete segments across the web to obtain independent control of power output to the segments.

By individually varying the power input to the discrete segments, preferential drying of the paper web can be accomplished. This preferential drying of the paper web can be used to control moisture content across the paper web to produce any desired profile of moisture variation across the web.

DESCRIPTION OF THE PRIOR ART

The use of a dielectric heating for drying paper is known. It has been applied to increase the overall drying effects on the sheet, drying inks, and curing glues. Similar uses of dielectric effects are made in the textile, refractory and composite materials industries for drying and curing. An interesting property of the dielectric heating effect is that water has a much higher dielectric constant than most other materials, especially air and paper. This means that there is a preferential heating on wetter areas of a web. For a single power input to a set of electrodes spanning the width of the paper web, there will be a strong tendency to dry preferentially the wetter areas of the web, resulting in a lessening of the moisture variation across the web. This natural tendency of a single dielectric heating unit does not, however, allow the segmented control to eliminate the moisture variation across the web altogether or to produce a desired profile of moisture variation across the web.

The dielectric heating effect is produced by creating a fluctuating electric field through which the material to be heated passes. The fluctuating electric field cause movements of the molecules in the material (with an intensity proportional to the dielectric constant of the molecules) and the movement causes a heating effect on the molecular level.

In addition to being proportional to the dielectric constant of the material the heating is proportional to the square of the applied voltage and the frequency. The fluctuating electric field is produced between two electrodes with one typically operated at a ground potential and the other operated at the high voltage. The electrodes themselves can have various configurations. They can be opposing flat plates, one plate as a high voltage electrode opposite an existing metal structure acting as ground, or parallel electrode rods.

SUMMARY OF THE INVENTION

The present invention seeks to improve the method of applying heat to a web by the use of dielectric heating by providing greatly increased control of the dielectric heating.

Accordingly the present invention is a method of applying heat to a web that comprises subjecting the web to dielectric heating in discrete segments, arranged transverse to the web.

In a particularly preferred aspect the web is a paper web on a paper making machine.

The preferred arrangement for this invention employs parallel electrode rods embedded in a dielectric insulating material acting as both an insulator to the high voltages and a structural support for the rods. In this arrangement a minimum of two electrode rods can be used to create the fluctuating field or a group of electrodes can be joined in parallel and alternately applied with the high voltage and ground. The paper web passes close to the electrodes and indeed may contact the dielectric insulating material and is heated by the fluctuating "fringe" of the electrode rod pairs.

Associated with each individual heating segment (that is each group of electrodes) is a power supply module. The power supply module supplies the high voltage, high frequency electric current which produces the fluctuating electric field. Although the power supply module can be controlled by duty cycle, the preferred power control is by variable voltage to maintain a constant energy input into the paper web. By monitoring the current flow and operating voltage of each power supply module, the average moisture content of the web in the segment associated with each power supply module can be deduced. By monitoring the current flow and operating voltage of each electrode pair, a finer resolution of the moisture content of the web in the cross machine direction can be deduced.

As a complete cross machine moisture control system, each electrode group representing a control segment is a replaceable module supported by a cross machine supporting structure. The associated power supply module of each electrode group module may be on the same support structure in close proximity to the electrode module, on a separate support structure in close proximity to the electrode module, or off the machine in a more convenient and accessible location. The electrode module supporting structure is also mounted such that it can retract clear of the paper web path to allow easy web threading and the like. This retract mechanism is typically interlocked to sheet break detectors and the like with a manual retract override. All power supply modules are typically interlocked to the retract mechanism to turn off the units when the electrode modules are away from the paper web. The location of this moisture control system is flexible and can be installed, with some slight resulting changes in efficiency, anywhere from the wet end of the paper machine to the dry end of the paper machine.

There is application for this system in controlled (cross machine) heating of the paper machine wires and felts when wet. The control may be biased to dry the wire (or felt) or to heat the wire (or felt) to a desired temperature profile as the water heats up.

DRAWINGS

Aspects of the invention are illustrated, merely by way of example, in the accompanying drawings in which:

FIG. 1*a* illustrates one embodiment of the present invention;

FIG. 1*b* illustrates a further aspect of the present invention, similar to FIG. 1*a;*

FIG. 1*c* illustrates dielectric heating using a part of a paper machine;

FIG. 1*d* shows a variation of the invention;

Figure 3:
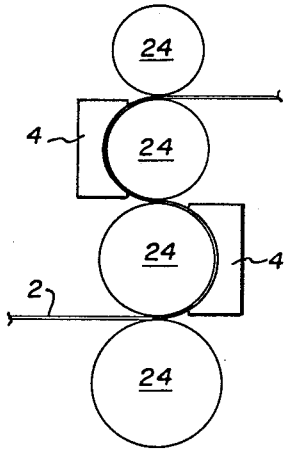
FIG. 3 illustrates dielectric heating in the calender.
Figure 3B:
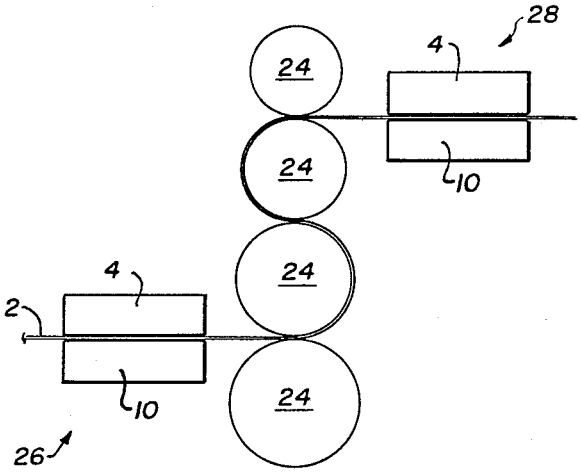

FIG. 3*b* illustrates a variation of FIG. 3; and

Figure 4:
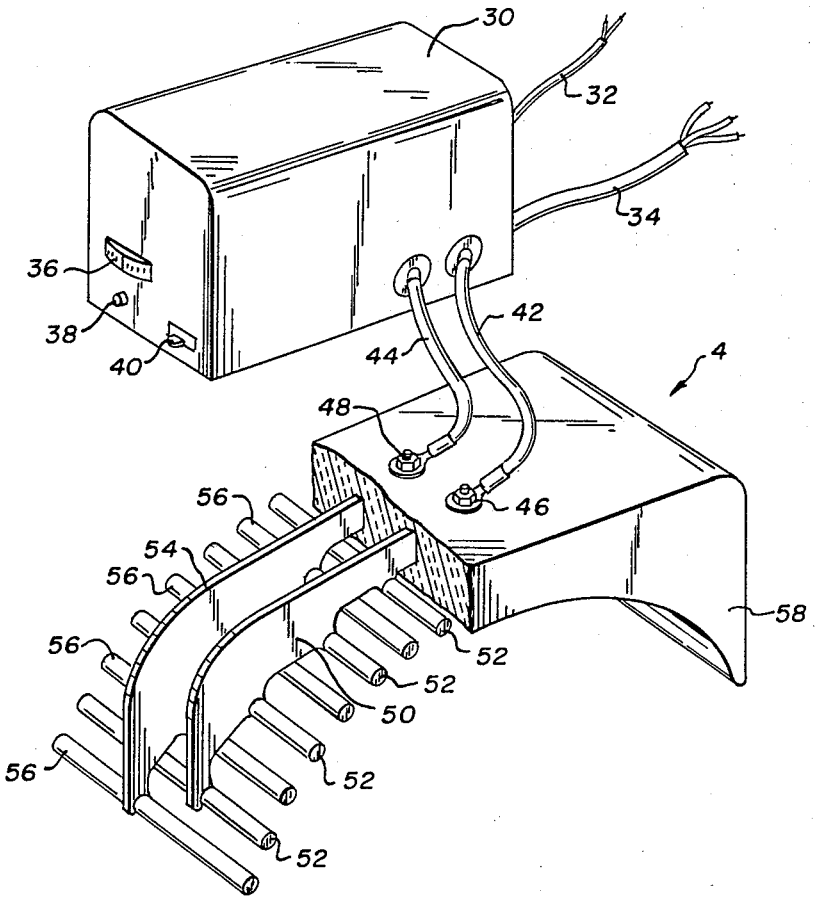

FIG. 4 shows a detail of an appliance useful in the method of the invention.

DESCRIPTION OF THE PREFERRED EMBODIMENTS

FIGS. 1*a* to 1*d* of the drawings show apparatus able to carry out the method of the present invention.

Figure 1A:
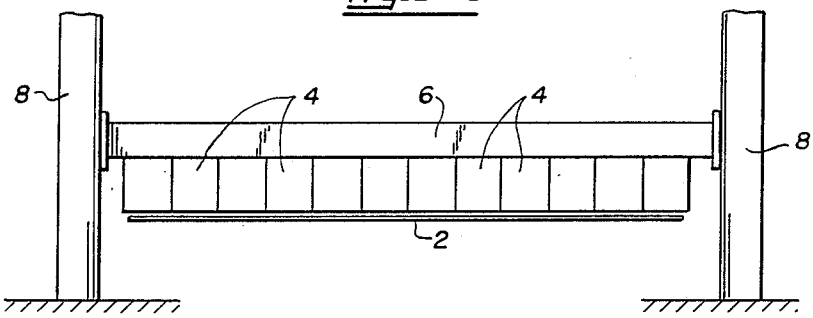

FIG. 1*a* shows a web 2 passing beneath a plurality of dielectric modules 4 carried by a support beam 6 that, in turn, is carried by uprights 8. The specific details of the dielectric modules are shown in FIG. 4 below. All the individual components of the illustrated apparatus are known.

Figure 1B:
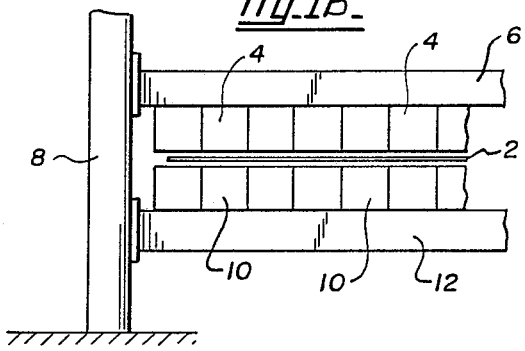
Figure 1C:
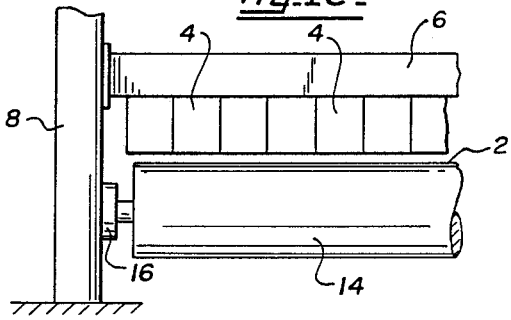

In FIG. 1*b* a variation of the FIG. 1*a* apparatus is shown in that the web 2 passes between additional, lower modules 10 mounted beneath the paper web 2 and carried by a second support beam 12 mounted on and supported by the uprights 8. In FIG. 1*c* the FIG. 1*a* configuration is modified by the positioning of the dielectric modules 4, with the support beam 6, over a part of the paper machine acting as an electrode. In the illustrated embodiment the additional component 14 is rotatably carried in bearings 16, one at each end of the component 14 although only one is shown, by the uprights and may, for example, be a dryer can or roll.

Figure 1D:
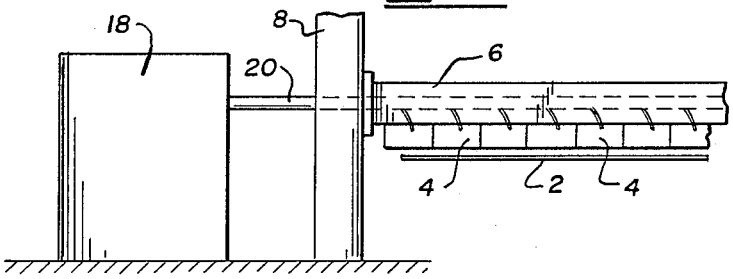

FIG. 1*d* illustrates a general feature of the present invention where the controls for the dielectric modules are externally mounted at 18. The necessary connections pass through conduit 20 to the modules 4.

Figure 2:
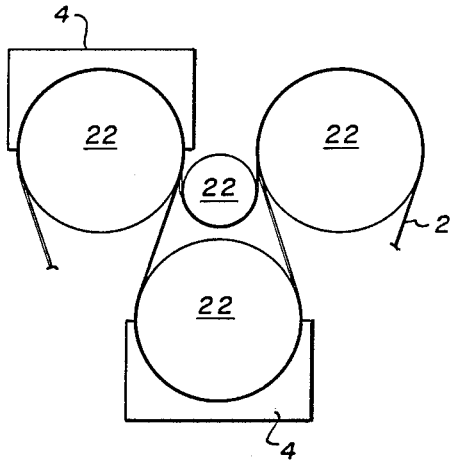
FIG. 2 illustrates the installation of dielectric heating in the dryer section.

FIG. 2 illustrates the installation of an apparatus in the dryer section of the paper making machine to permit the application of the method of the present invention. The paper web 2, passing over rolls 22 is subjected to dielectric heating by the module 10 arranged, as shown in FIGS 1*a* to 1*b*, in discrete segments, across the web 2.

FIG. 3 simply indicates the installation of the dielectric modules on calender sides. Calender rolls 24 are shown. FIG. 3*b* differs from the structure of FIG. 3 in that the dielectric modules 4 and 10 are positioned over the web at 26, that is prior to the calender rolls 24, and at 28, that is after the calender rolls 24, rather than closely associated with the calender rolls 24 as shown in FIG. 3.

FIG. 4 is a somewhat diagrammatic drawing of an apparatus useful to carry out the method of the invention. That is it shows more specifically the modules 4 of the preceding figures. FIG. 4 shows a power module 30 having logic level voltage control leads 32 and power input leads 34, typically at 50/60 Hz. The power module 30 has a power level gauge 36, manual control knob 38 and an on/off circuit breaker 40. High voltage leads 42 and 44 make contact with the dielectric module 4 at contacts 46 and 48. Contact 46 conveys current to positive distributor plate 50, which in turn conveys current to positive electrodes 52. Contact 48 conveys current to negative distributor plate 54, which conveys current to negative electrodes 56. The plates 50 and 54 are encapsulated within a dielectric potting material 58. The shape of potting material 58 conforms to the external circumference of a roller, for example calendar roll 24 in FIG. 3, the electrodes 52 and 54 being equally spaced from the web.

Thus the present invention offers particular advantages in applying heat to a web. The degree of control supplied by the heating system as exemplified by the apparatus illustrated in the drawings, offers the flexibility of controlling secondary properties of a web when the secondary properties are directly influenced by the primary, controlled properties of temperature and moisture control. One example of controlling the secondary properties is controlling the caliper or smoothness by controlling the temperature profile of a web entering the calender stack, as shown in FIGS. 3 and 3*b*. Another example is controlling the re-wetting effects on the paper sheet at the AFT region of a press nip by controlling the moisture content of the press felt.

I claim:

1. A method of applying heat to a paper web by subjecting the web to dielectric heating in discrete segments, comprising the steps of:

providing a plurality of discrete heating modules distributed transverse to the width of the web and all opposite one major surface of the web to control moisture in the web in the cross-machine direction;

providing in each of said heating modules a plurality of pairs of equally-spaced heating electrodes, with said heating electrodes extending over a respective one of said discrete segments in a spaced-apart array facing said surface of the web and with said heating electrodes being equally spaced from the web;

connecting one electrode of each of said pairs together to a first current supply conductor and the other electrode of each of said pairs together to a second current supply conductor; and energizing said heating modules by supplying an electrical current through said conductors to effect dielectric heating of said web so that the web is heated by current flow between said electrodes in accordance with the moisture profile of said web.

2. A method as claimed in claim 1 in which the input power to the discrete heater modules is set by duty cycle control for each discrete heater module.

3. A method as claimed in claim 1 in which the input power to the discrete heater module is set by variable voltage control at each heater module.

4. A method as claimed in claim 1 in which the input power to each discrete heater module is set by thyristor control of incoming alternating current to each heater module.

5. A method as claimed in claim 1 in which input power to the discrete heater modules is set by varying the distance of the web in each discrete segment from the electrodes of the dielectric heating unit for each heater module.

6. A method as claimed in claim 1 in which the input power to the discrete heater modules is set by varying the frequency of the dielectric heating unit in each heater module.

7. A method as claimed in claim 1 in which the input power levels to the discrete heater modules is decided by a computer in response to a signal from a sensor, sensing the web.

8. A method as claimed in claim 1 in which the web is a paper web on a paper making machine.

9. A method as claimed in claim 1 in which the electrodes are rods arranged with their longitudinal axes in the machine direction.

10. A method as claimed in claim 7 in which the sensor is able to sense moisture.

11. A method as claimed in claim 7 in which the sensor measures the temperature.

* * * * *